US006052837A

United States Patent [19]

Norton et al.

[11] Patent Number: 6,052,837

[45] Date of Patent: Apr. 25, 2000

[54] TOILET VENTILLATION SYSTEM

[76] Inventors: John A. Norton, PMB #180, 2600A E. Seltice Way, Post Falls, Id. 83854; Neal A. Davis, 25125 E. Trent Ave., Newman Lake, Wash. 99025

[21] Appl. No.: 09/378,156

[22] Filed: Aug. 20, 1999

[51] Int. Cl.[7] ..... E03D 9/052

[52] U.S. Cl. ..... 4/217; 4/213

[58] Field of Search ..... 4/213, 216, 217

[56] References Cited

U.S. PATENT DOCUMENTS

| | | | |
|---|---|---|---|
| 1,401,091 | 12/1921 | Lucas | 4/213 |
| 1,937,305 | 11/1933 | Baither | 4/213 |
| 2,171,903 | 9/1939 | Aubin | 4/213 |
| 2,988,756 | 6/1961 | Hartley | 4/213 |
| 3,939,506 | 2/1976 | Pearson | 4/213 |
| 4,984,310 | 1/1991 | Casale | 4/213 |
| 5,161,262 | 11/1992 | Quaintance, Sr. | 4/213 |
| 5,325,544 | 7/1994 | Busch | 4/213 |
| 5,388,280 | 2/1995 | Sim | 4/213 |

*Primary Examiner*—Charles R. Eloshway
*Attorney, Agent, or Firm*—David S. Thompson

[57] ABSTRACT

A toilet ventilation system moves air from within a toilet bowl and through a filter, or alternatively, out of the building by means of an exhaust pipe or duct. The ventilation system provides a toilet seat assembly having an air channel defined by the lower surface of the seat. An air channel cover is removably held in place on the lower surface of the toilet seat, covering the air channel. By removing the air channel cover the user may easily clean the air channel. A bowl-mounted base and enclosure is attached to the toilet bowl by means of the standard mounting bolts used to attach toilet seats. The toilet seat and lid are pivotally carried by the bowl-mounted base. A reservoir with a drain opening prevents the passage of liquid into a fan and filter housing. The fan and filter housing, carried by the bowl-mounted base, contains a fan powered by a direct current electrical system and an activated charcoal filter.

4 Claims, 9 Drawing Sheets

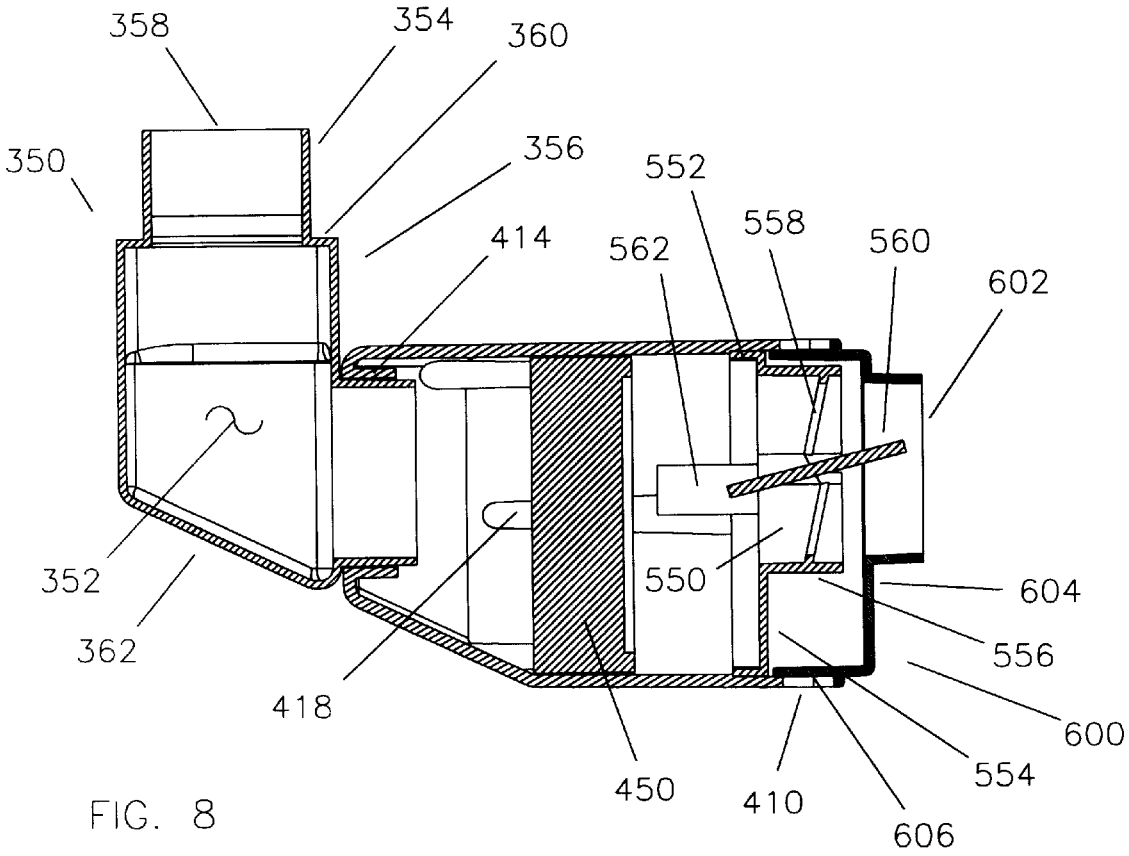
FIG. 8
FIG. 9
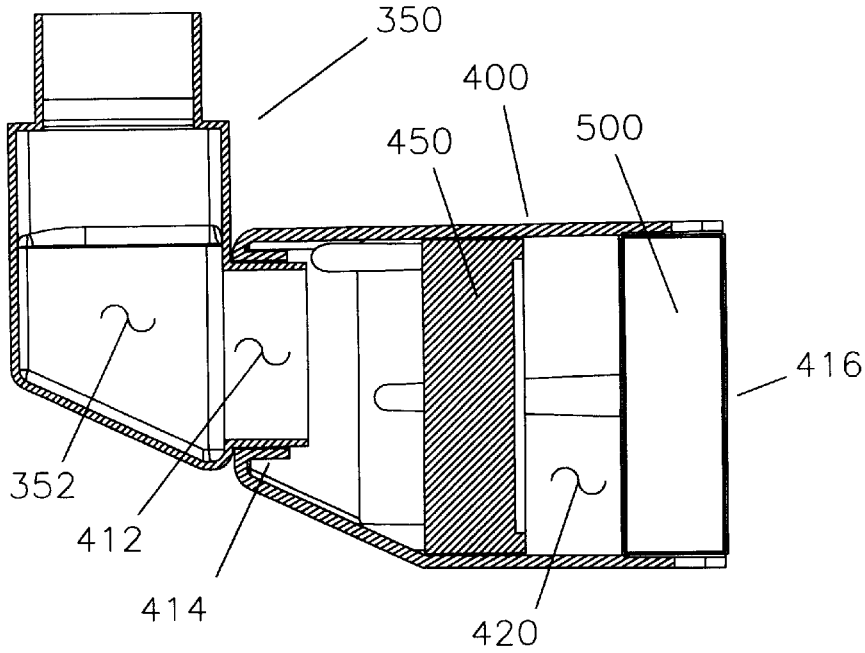

TOILET VENTILLATION SYSTEM

BACKGROUND

It is known to use a forced air ventilation system to either vent or filter the noxious odor associated with toilet use. However, the known devices have many structural shortcomings. As a result, the popularity of such devices, and their commercial availability, has not been good.

Many toilet ventilation systems have failed to provide a structure that is easily cleaned. As a result, in time, such systems may actually become a cause of odor.

Other toilet ventilation systems have failed to provide a functional mechanism that may be conformed to fit within an attractive enclosure, and as a result have been unsuccessful in gaining market acceptance.

Other toilet ventilation systems have failed to provide an effective switching system to control the fan. In some systems, this results in the fan being active for extended periods, causing excessive noise and heat loss during the winter. In some systems, this results in a failure to activate the system when needed.

Known toilet ventilation systems have also failed to provide an air speed controller, to regulate the speed and volume of air flowing through the ventilation system. Failure to provide such an air speed controller results in one or more undesired results, including: reversal of the direction of air travel; excessive or insufficient air volume; changing air speed due to outside wind and pressure differences where the system is vented to the outside; changing air speed as a filter becomes clogged; and, changing air speed depending on the charge and voltage level of the system power supply. To provide a constant level of ventilation at a desired rate of flow, the toilet ventilation system must at times apply power to the fan in a variable manner, due to constantly changing environmental, filter and battery conditions.

For the foregoing and other reasons, there is a need for a new and improved toilet ventilation system that can easily be cleaned and maintained in new condition. The toilet ventilation system must be attractive or inconspicuous, and must have a switching system that promotes operation when the device is needed, and that saves energy when it is not needed. The toilet ventilation system must also provide an air speed controller, to regulate the speed and volume of air flowing through the system.

SUMMARY

The present invention is directed to an apparatus that satisfies the above needs. A novel toilet ventilation system is disclosed that is easily cleaned, provides an attractive enclosure adapted to fit standard toilets and a switching system that maximizes its effectiveness. The toilet ventilation system also provides an air speed controller, which allows the air speed and flow volume to be regulated. The toilet ventilation system includes some or all of the following components:

(A) A toilet seat provides a lower surface defining an air channel, thereby promoting the removal of air from all sides of the toilet bowl.

(B) An air channel cover is carried by the lower surface of the toilet seat, covering and further defining the air channel. Slots in the air channel cover allow air to enter the air channel, while keeping the air channel sufficiently enclosed to encourage a directed air flow. The air channel cover may easily be removed to allow the air channel and air channel cover to be cleaned.

(C) A toilet bowl-mounted base having a fitted enclosure connects to the toilet bowl by means of the bolts typically used to attach the toilet seat/lid assembly. The bowl-mounted base and enclosure define an air channel communicating with the air channel of the toilet seat.

(D) A fan housing, supporting a direct-current fan, defines an air passage in communication with the the bowl-mounted base and enclosure. Air drawn though the air channel defined in the toilet seat passes through air channel in the the bowl-mounted base and enclosure, and then passes into the fan and filter housing where it is forced by the fan through an activated charcoal filter.

(E) Microcontroller means, in communication with the switching means and the fan, for controlling the operation of the fan in response to the switch and the anemometer, various indicator lights and for controlling the operation of the solenoid controlling the damper.

(F) Switching means, in communication with the microcontroller means, for sensing that a person is sitting on the seat. A preferred switching means includes a pressure sensitive switch, and is carried by the toilet bowl-mounted base, and is sensitive to slight deflection of components due to the weight of the person.

(G) Air speed control means, including software executed by the microcontroller and an anemometer connected to the microcontroller, for regulating the speed of the air and volume of the air flow.

(H) Delay means, executed by the microcontroller, for regulating the time during which the fan is in operation after the switching means no longer senses a person sitting on the seat. In a preferred embodiment, the delay means is entirely executed in software.

(I) Manual air speed adjustment means, executed by the microcontroller-based circuit and in electrical communication with the fan means, for allowing adjustment of an input to the microcontroller, thereby manually providing a target level at which the microcontroller attempts to maintain the air speed or air volume.

It is therefore a primary advantage of the present invention to provide a novel toilet ventilation system having an air speed control means for achieving the desired air speed and air flow volume.

Another advantage of the present invention is to provide a toilet ventilation system having structures that are adaptable to the installation of a fan and odor absorbing filter within the bathroom, or to the installation of a fan in a local or remote location to exhaust the air through a duct to the building exterior.

Another advantage of the present invention is to provide a toilet ventilation system having structures that are easily retrofitted to existing room and toilet.

Another advantage of the present invention is to provide a toilet ventilation system having structures that are concealable within an attractive enclosure conducive to commercial acceptance and which is easily cleaned and maintained in a hygienic and odor free condition.

A still further advantage of the present invention is to provide a toilet ventilation system having a fan which is electrically switched on and off in an automatic manner.

DRAWINGS

These and other features, aspects, and advantages of the present invention will become better understood with regard to the following description, appended claims, and accompanying drawings where:

FIG. 8 is a side cross-sectional view of the exhaust housing and fan housing of the toilet ventilation system of FIG. 1, having a fan and a damper assembly installed.

FIG. 9 is a side cross-sectional view of the exhaust housing and fan housing of the toilet ventilation system of FIG. 1, having a fan and a filter installed.

Figure 10C:
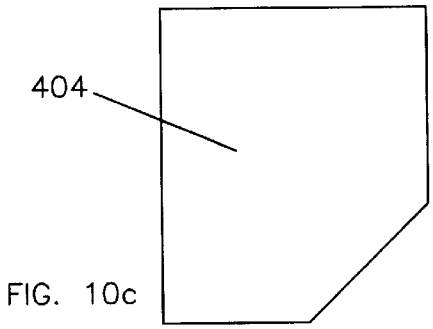
Figure 10F:
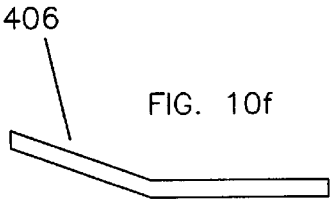
Figure 10D:
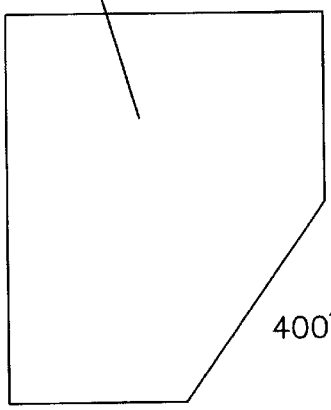
Figure 10A:
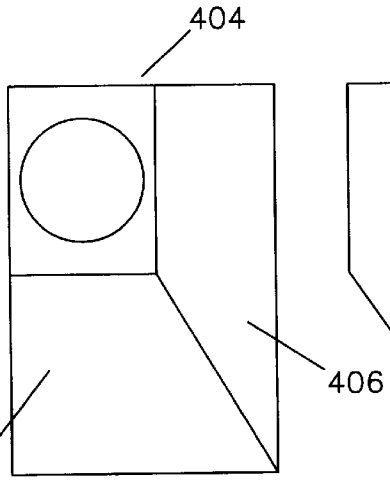

FIG. 10*a* is an isometric view of the input end of the fan housing.

Figure 10E:
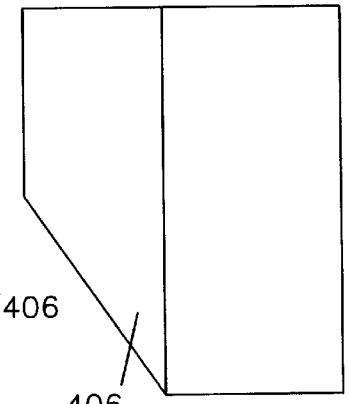
Figure 10H:
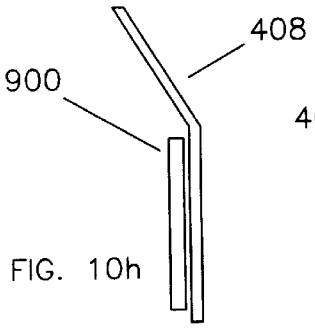
Figure 10G:
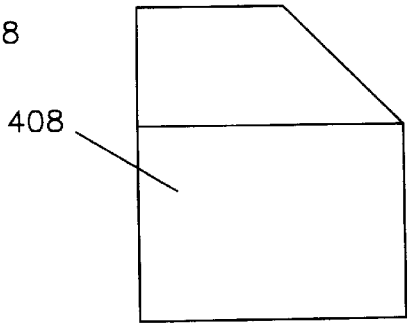
Figure 10B:
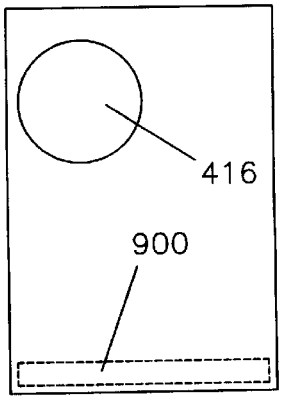

FIG. 10*b* is an isometric view of the output end of the fan housing, showing the circuit card in dotted outline.

FIG. 10*c* is a view of the narrow planar side of the fan housing.

FIG. 10*d* is a side view of the wide planar side of the fan housing.

FIG. 10*e* is a side view of the wide bi-planar side of the fan housing.

FIG. 10*f* is an edge view of the wide bi-planar side of FIG. 10*e,* showing how that side is constructed.

FIG. 10*g* is a side view of the narrow bi-planar side of the fan housing.

FIG. 10*h* is a side view of the narrow bi-planar side of FIG. 10*g,* showing how that side is constructed, and additionally showing how the circuit card is carried adjacent to the side.

Figure 11:
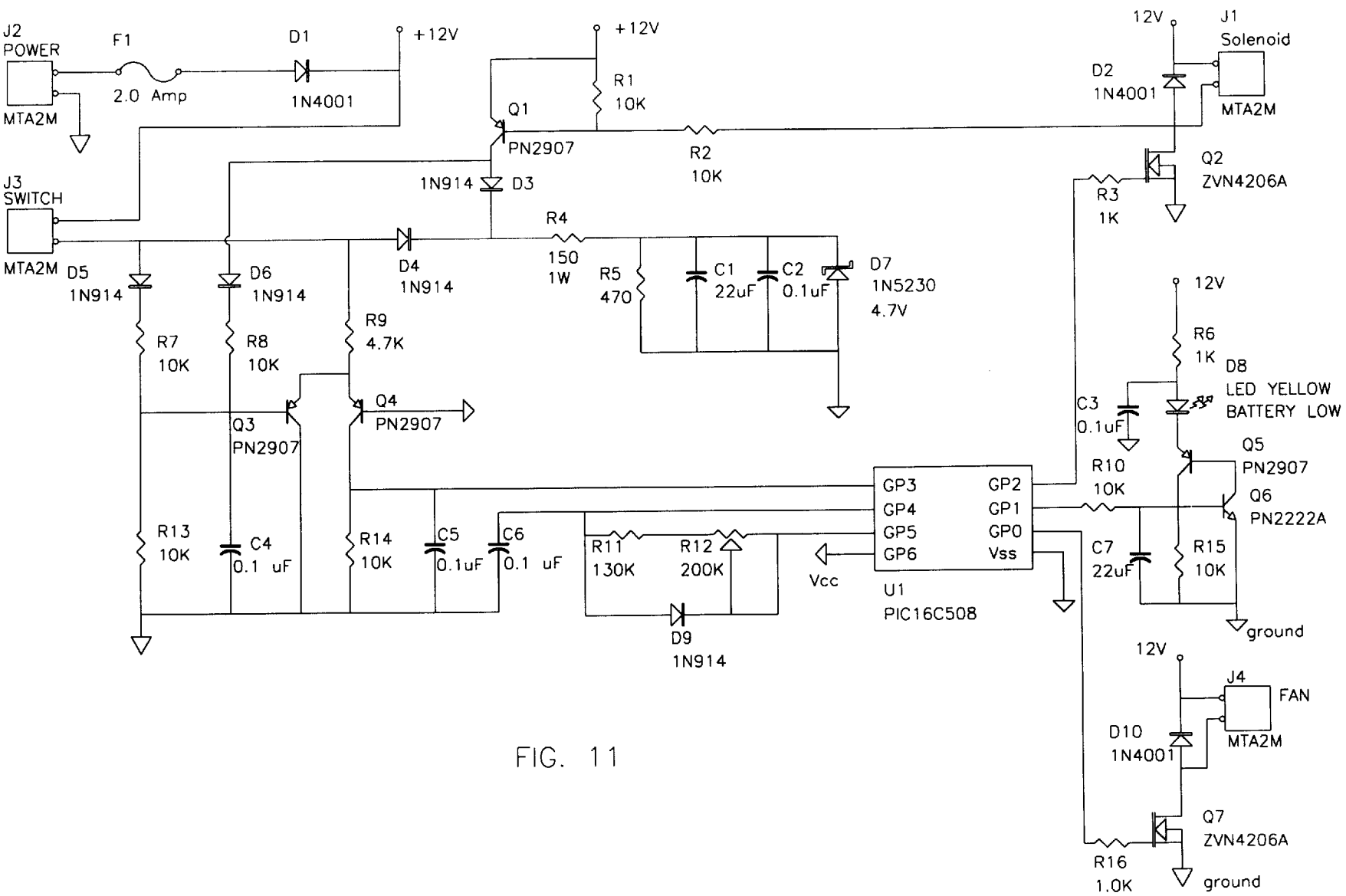

FIG. 11 is a view of a circuit schematic showing a version of the electronic components required to operate the fan, air speed controller, indicator lights, timer and other functionality.

DESCRIPTION

Referring generally to FIGS. 1 through 4, a toilet ventilation system constructed in accordance with the principles of the invention is seen. The preferred version of the toilet ventilation system provides a pivoting lid 100 and seat 150. A lower surface of the seat defines an air channel, which is covered by a releasable air channel cover 200. The seat is supported by a base 250 which is attachable to the bowl portion of any standard toilet by hinges 700, which flex slightly under weight, allowing the activation of a switch 850. The base supports an enclosure 300 which defines a further air channel in communication with the air channel of the seat. An exhaust housing 350 allows air transfer from the enclosure into a fan housing 400 which carries a fan 450, and in the preferred embodiments either a filter 500 or a damper assembly 550. A pipe adapter 600 allows for alignment with exhaust piping, if applicable. A microcontroller-base, circuit in communication with the switch and fan, controls the operation of the fan in response to the switch and the anemometer, controls various indicator lights and controls the operation of the solenoid controlling the damper. Air speed control means includes software executed by the microcontroller and an anemometer which allows the air speed and flow volume to be precisely controlled. Delay circuit means results in continued operation of the fan for a timed period after the switch is released. Manual air speed adjustment means allows the user to adjust the target air speed, which the microcontroller attempts to maintain.

Figure 1:
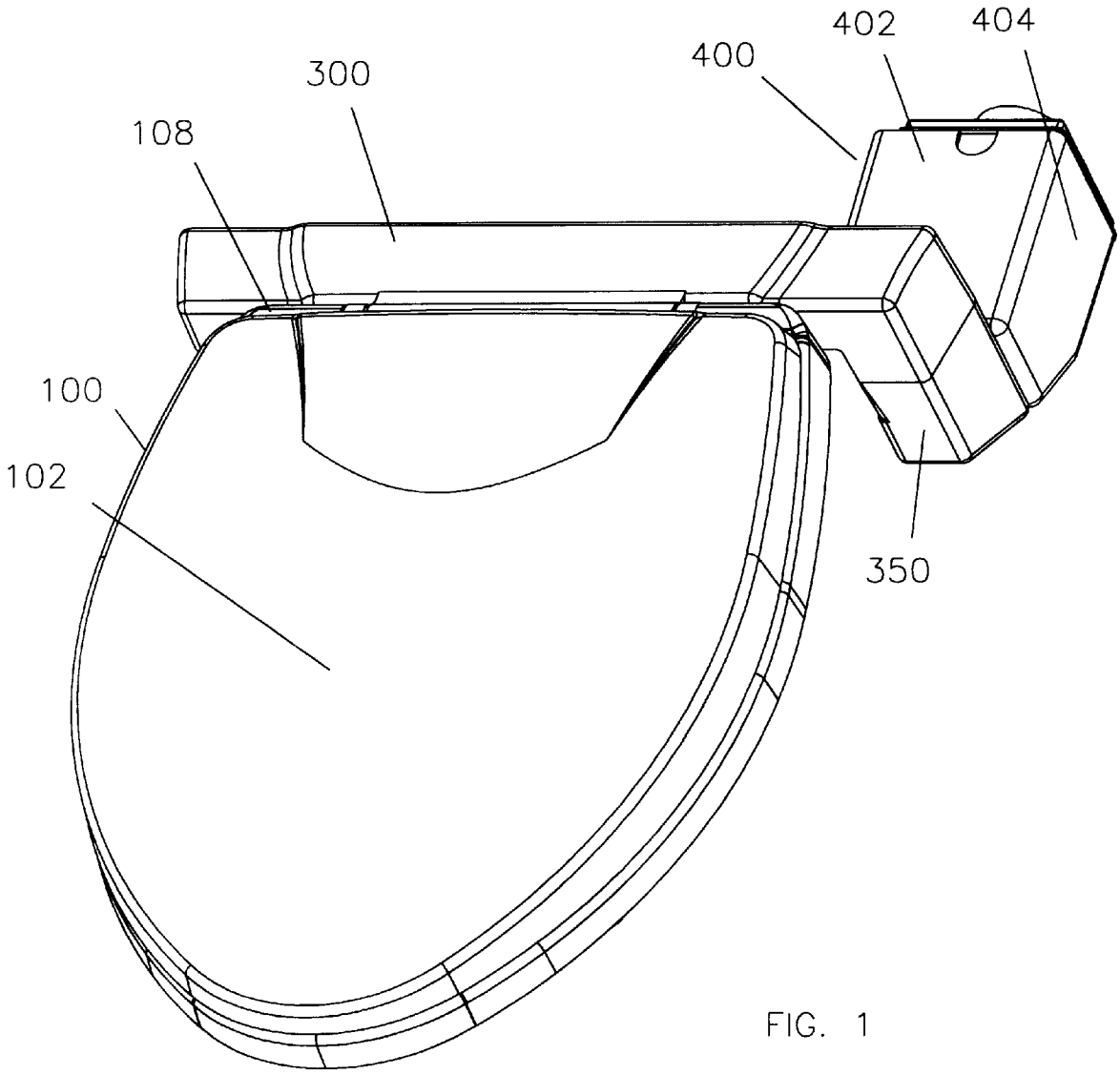
FIG. 1 is a perspective view of a preferred version of the toilet ventilation system of the invention.
Figure 3:
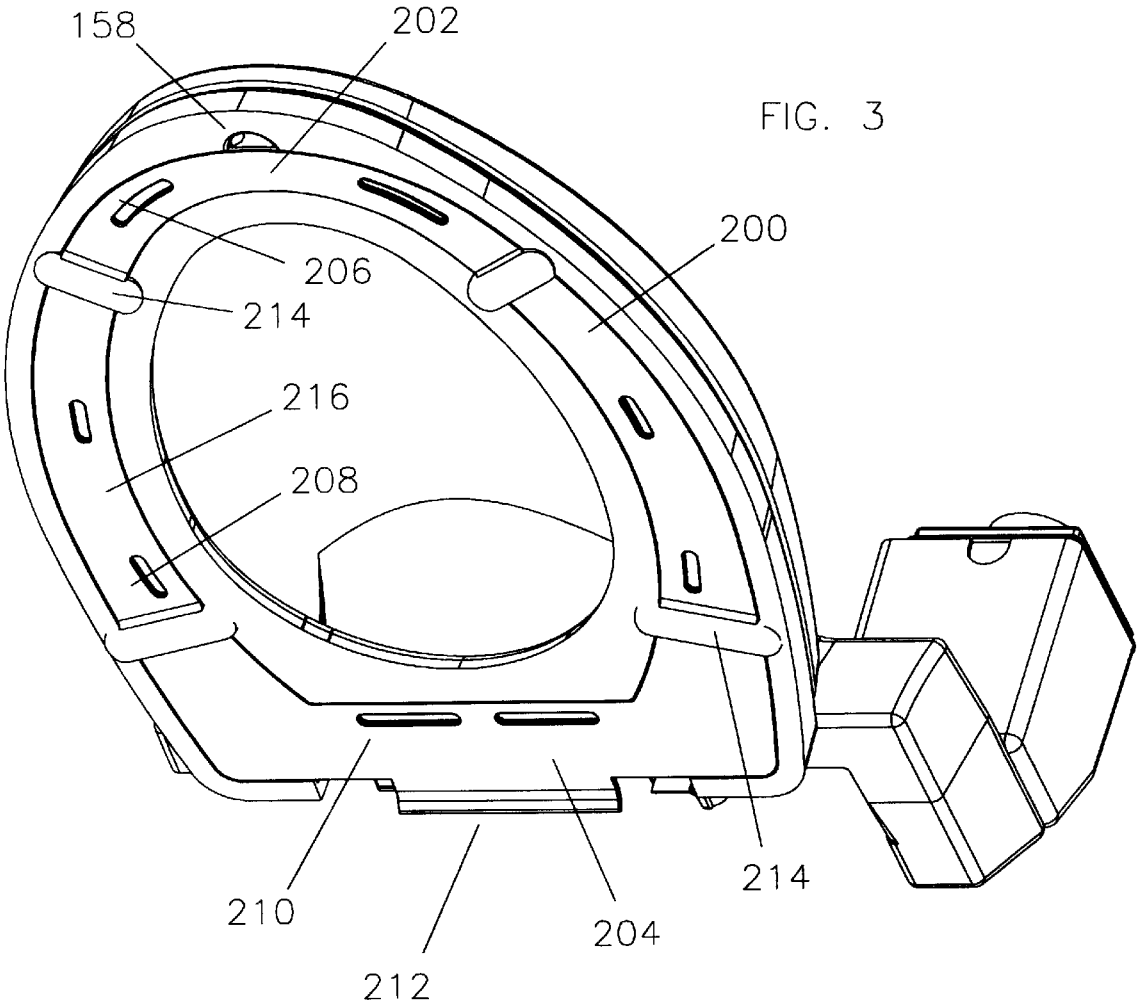
FIG. 3 is a perspective view of the toilet ventilation system of FIG. 1 taken from a lower view point.
Figure 3A:
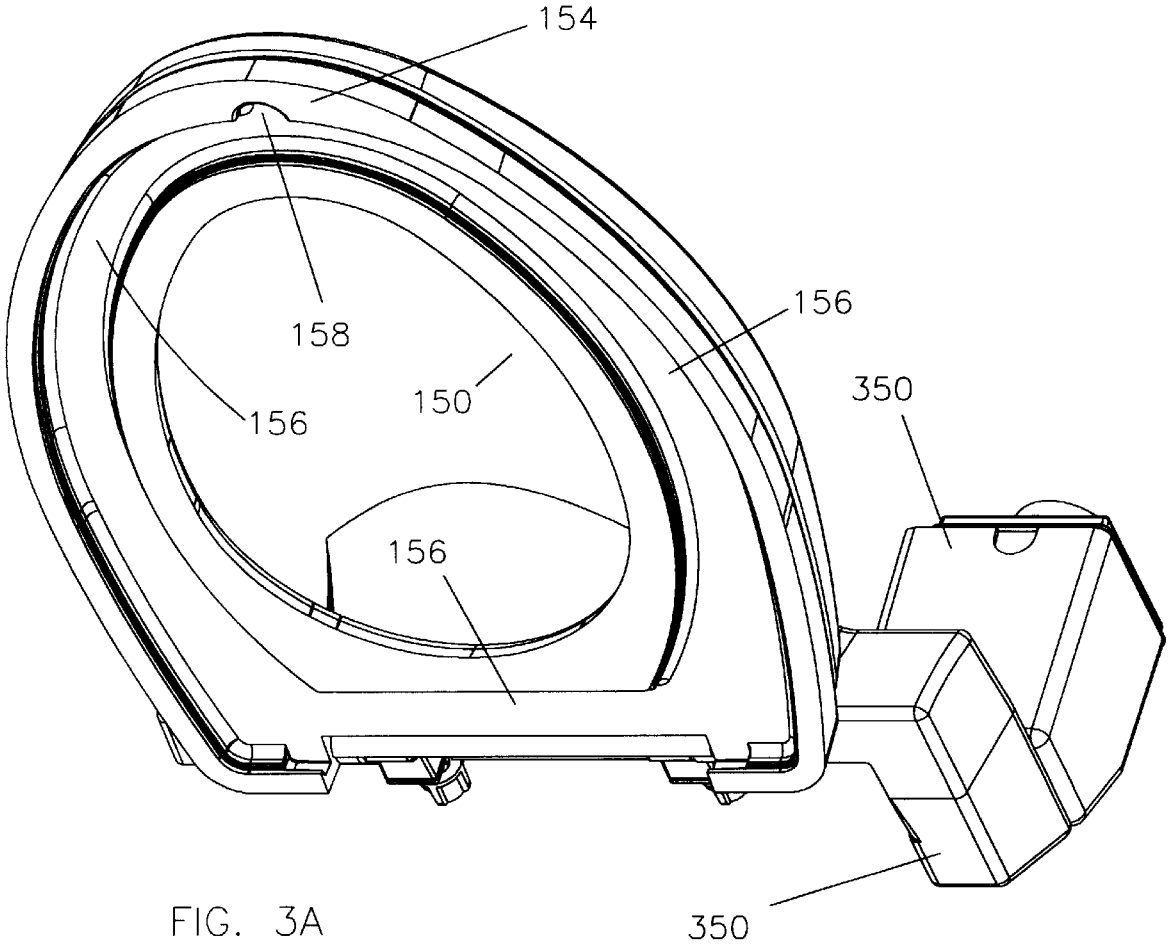
FIG. 3A is a perspective view similar to that of FIG. 3A, having the air channel cover removed.
Figure 4:
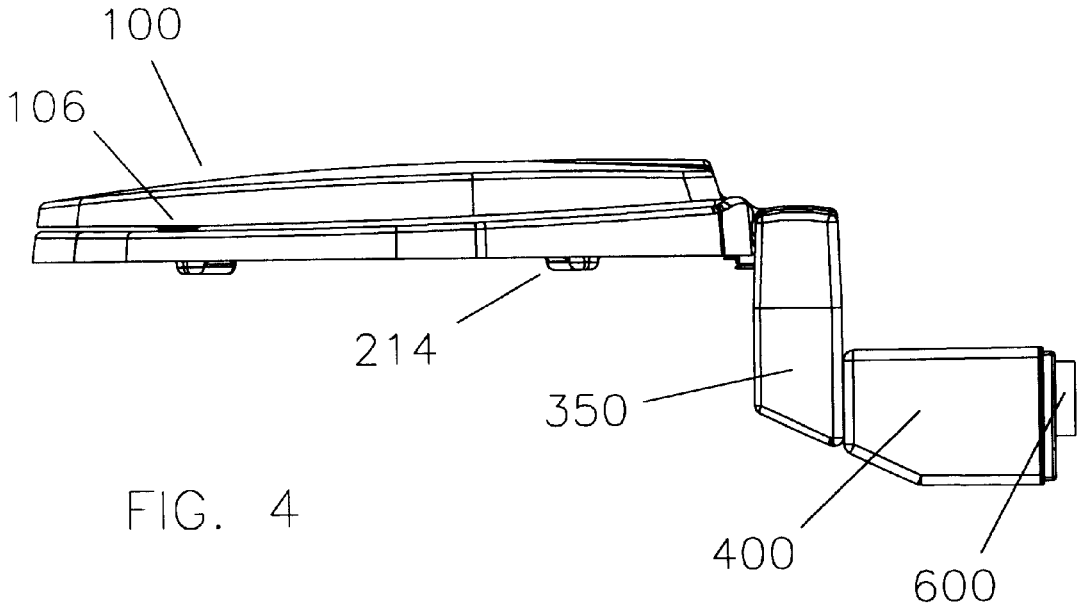
FIG. 4 is a side orthographic view of the toilet ventilation system of FIG. 1.

Referring particularly to FIGS. 1 and 4, the lid 100 is seen in the closed position. In FIG. 3 the lid is seen in the open position. In a preferred embodiment, the lid provides upper and lower surfaces 102, 104, and is supported by a hinge 108. Referring particularly to FIG. 4, support feet 106 are sized to contact the seat 150, and support the lid in the closed position.

Figure 2:
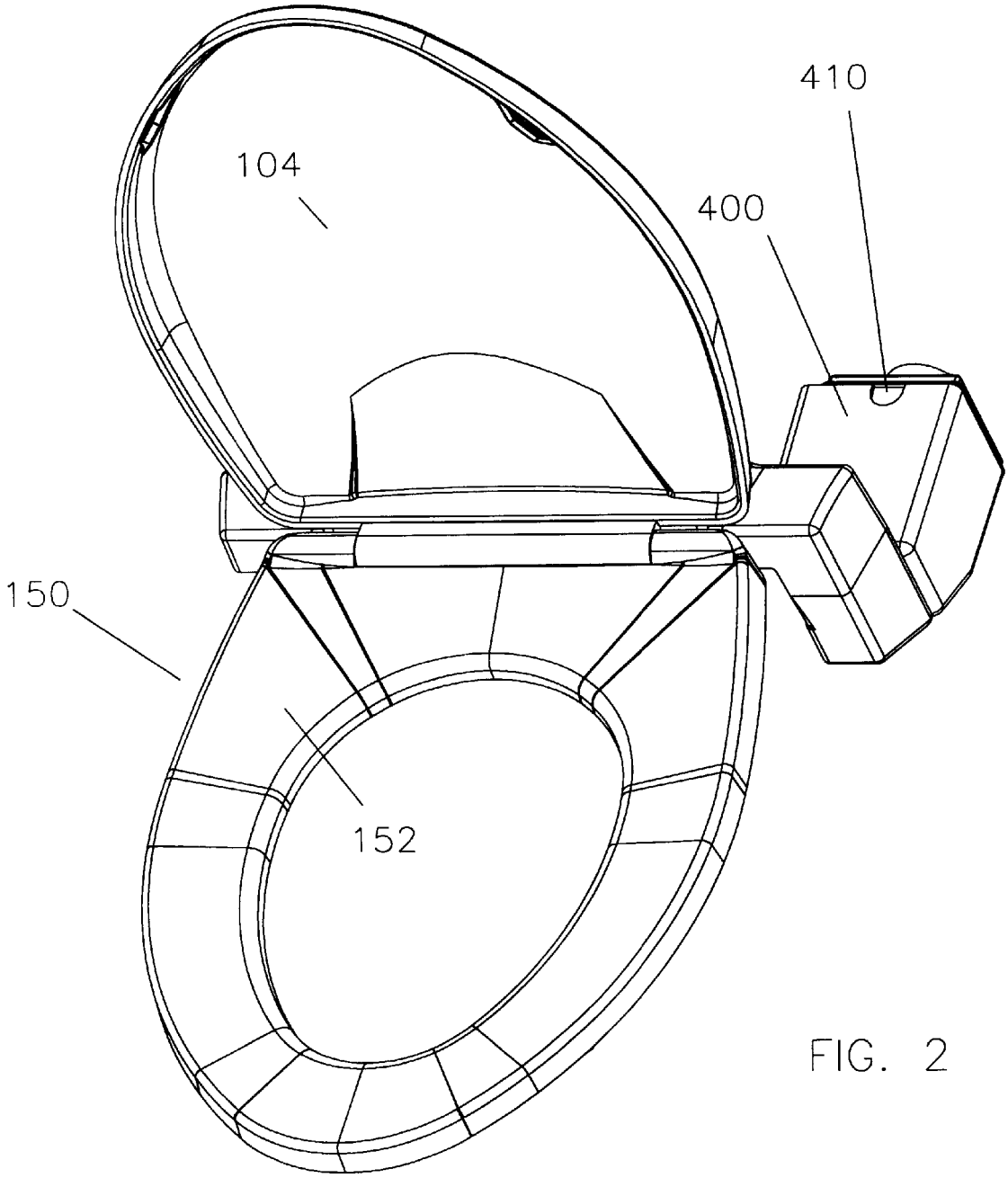
FIG. 2 is a perspective view of the toilet ventilation system of FIG. 1, having the lid opened.

Referring particularly to FIGS. 2, 3, 3A and 4, the seat 150 is seen in the lowered position. As seen in FIG. 2, the seat provides an upper surface 152, which is conventional in appearance. However, referring to FIG. 3A, it can be seen that the lower surface 154 defines an air channel 156, which in the preferred embodiment extends in a loop about the entire lower surface. Where the toilet seat is a split-ring design, the channel does not form a complete loop. A thumb hole 158, defined in the lower surface adjacent to the air channel 156, allows for convenient removal of the air channel cover 200.

Referring particularly to FIG. 3, a generally planar air channel cover 200 is sized to snap into the lower surface 154 of the seat 150 in a frictional fit manner, further defining the air channel 156 within the seat. The air channel cover typically provides a curved forward portion 202, sized to conform to the shape of the forward portion of the seat 150. A generally straight rear portion 204 conforms to the shape of the rear portion of the seat. The curved forward portion of the air channel cover typically provides a plurality of front and middle slots 206, 208, which allow air passage from the bowl area of the toilet into the air channel 156. Rear slots 210, defined in the straight rear portion 204 of the air channel cover, allow additional air passage from the bowl area of the toilet into the air channel 156 of the seat. In a typical embodiment, the front and rear slots are 2" long, while the middle slots are 1" long.

A fluid guard 212, carried by a rear edge of the straight rear portion 204, deflects fluid downwardly and into the toilet bowl, preventing entry into the air channel 302 of the enclosure 300, as will be seen.

Support feet 214, defined in the lower surface 216 of the air channel cover, support the seat 150 on the rim of the toilet's bowl. In the preferred embodiment, four support feet are distributed about the cover, as seen in FIG. 3, in a manner that best supports the seat on the toilet's bowl.

Figure 5:
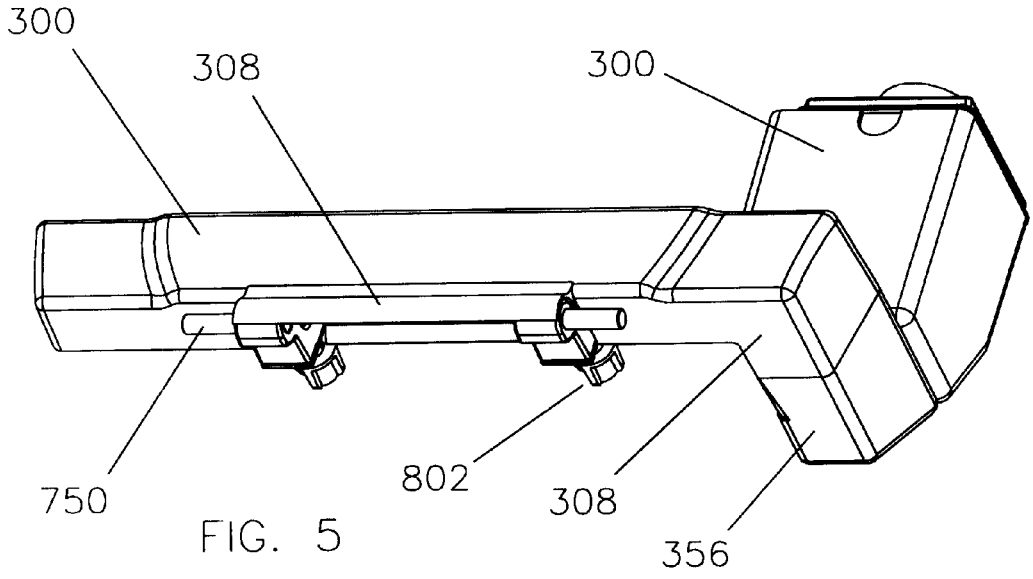
FIG. 5 is a perspective view of the base, enclosure, exhaust housing and fan housing of the toilet ventilation system of FIG. 1.
Figure 6:
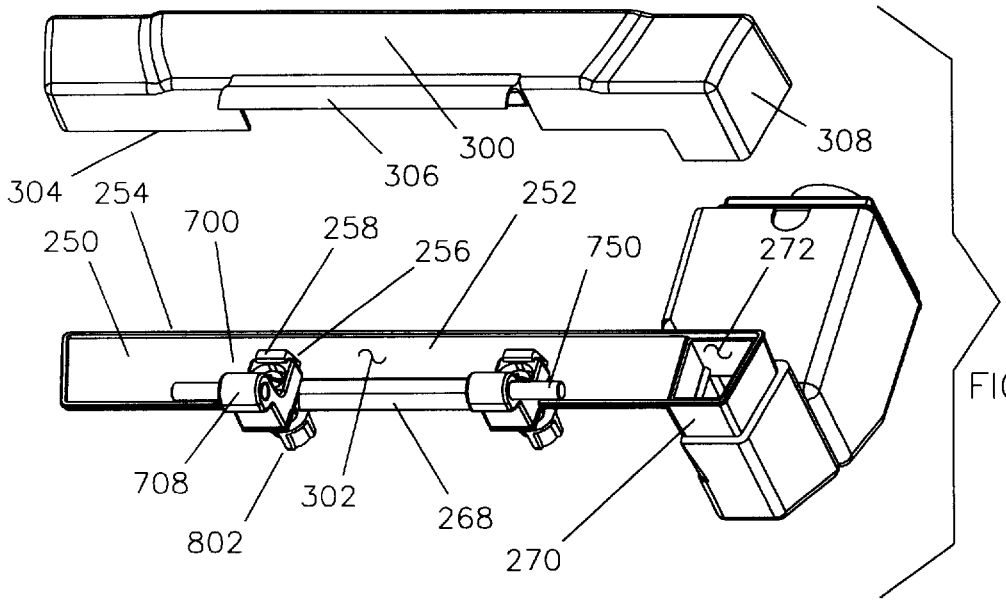
FIG. 6 is an exploded perspective view of the components of FIG. 5, having the enclosure lifted off the base to reveal the hinges.
Figure 7:
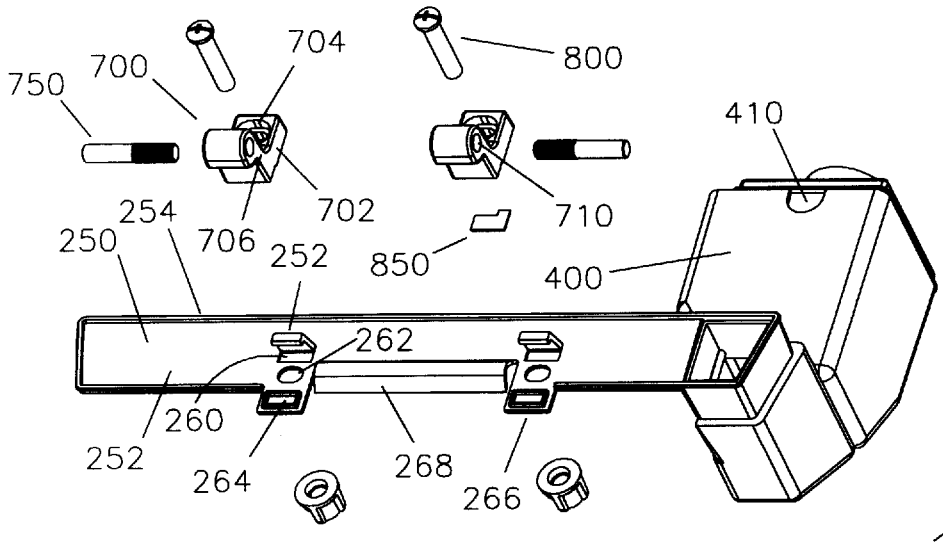
FIG. 7 is an exploded perspective view of the components of FIG. 6, having the enclosure removed and the hinges and associated parts exploded.

Referring to FIGS. 5, 6 and 7, it can be seen that left and right hinges 700 support the seat 150 and lid 100 in a pivoting manner. As seen in the exploded view of FIG. 7, each hinge 700 provides a hinge base 702 which defines a bolt hole 704 sized to accept the standard mounting bolt 800 and associated nut 802 that are commonly used to secure toilet seats to toilet bowls.

Extending upwardly from the base 702 is a neck 706. The size and shape of the neck of the hinge, as well as the material of manufacture, should be selected so that the neck deflects slightly when weight is applied to the seat. This allows a switch 850 to make electrical contact, as will be seen. The neck supports a head portion 708, which defines a hinge pin hole 710, which is sized to support the hinge pin 750, as is best seen in FIGS. 6 and 7. Left and right hinge pins 750, carried by left and right hinges 700, support the seat 150 and lid 100 in a pivoting manner, as seen in FIGS. 1–4.

Referring to the exploded views of FIGS. 6 and 7, the structure of the base 250 may be understood. A floor portion 252 of the base is adapted to be carried by the rear portion of the upper rim of the toilet bowl. A perimeter portion of the floor defines a rim 254 that allows attachment of an enclosure 300, as will be seen. Referring now to FIG. 7, the floor also defines two bolt holes 262, which allow the mounting bolts 800 to be installed. Left and right support arms 256 extend upwardly from the floor, and terminate in hook portions 258. As seen in FIG. 8, the hooks 258 are sized to grasp the base 702 of each hinge 700, thereby preventing rotation of the hinges when weight is applied to the seat 150. Left and right slots 260 are associated with the requirements of the plastic part manufacturing process.

Left and right switch pad supports 264 are carried by left and right tabs 266, which are extensions of the floor 252. Each switch pad support is a typically rectangular rim which allows the installation of a slightly compressible switch pad of rubber or similar material (not shown for reasons of clarity), which supports and protects the switch 850. By providing both left and right switch pad supports installation of the switch 850 on either side of the base 250 is possible.

A guard 268, carried by a forward center portion of the floor 252, tends to deflect liquid into the toilet bowl, thereby preventing entry into the air channel 302 defined within the enclosure 300.

A downspout 270, seen in FIGS. 6 and 7, defines an air channel 272 which allows communication between the air channel 302 of the enclosure and an air channel 352 in the exhaust housing 350.

Referring to FIG. 7, a preferred switching means for sensing the presence of a person sitting on the seat and for inputting that information to a microcontroller includes the switch 850 is seen in the exploded view. The switch is carried on a support pad of rubber or similar material that is carried by either the left or right switch pad support 264 of the base 250. The switch should be of a pressure sensitive type, which is therefore activated by the weight of a person sitting on the seat 150, which in turn flexes the necks 706 of the hinges 700, bringing the lower surface of the hinge base 702 into contact with the switch. The rubber switch pad (not shown) tends to compress when weight is applied, thereby protecting the switch from damage.

Referring to FIGS. 5 and 6, an enclosure 300 is releasably attachable to the base 250, thereby forming an air channel 302. The enclosure provides a rim 304 which mates with the rim 254 of the base 250, forming a seal. A top portion of the enclosure may be removed for cleaning, and can then be snapped back into place. Referring in particular to FIG. 6, a guard 306 protects the hinges 700 and hinge pins 750, and provides a more esthetic appearance.

By comparison of FIGS. 5 and 6, it can be understood how the downwardly directed flange 308 covers the insert flange 354 of the exhaust housing 350. The flange 308 is sized incrementally larger than the insert flange 354; therefore the insert flange fits tightly inside the flange 308.

Referring to FIGS. 7, 8 and 9, a downwardly directed exhaust housing 350 is seen. The air channel 352, defined within the exhaust housing 350, allows air to transfer from the air channel 302 in the enclosure to the air channel 420 defined within the fan housing 400.

The exhaust housing 350 provides an upper insert flange 354, best seen in the cross-sectional view of FIGS. 8 and 9, which is insertable into the flange 308 of the enclosure. A shoulder 360 defines the transition between the insert flange and a lower tube 356. In the preferred embodiment of the invention the exhaust housing employs a flat-sided construction and a sloping base 362. In a preferred version of the sloping base 362, a very small drain hole allows moisture to drain, if necessary.

An exhaust port 358, seen in the cross-sectional views of FIGS. 8 and 9, is typically round, thereby allowing rotation of the fan housing which attaches to the exhaust port.

The fan housing 400, seen in FIGS. 1–9, defines an air channel 420, which allows air to transfer from the air channel 352 in the exhaust housing. Air therefore moves from the forward opening 412 to a rear opening 416.

A collar 414 is sized to slide over the round exhaust port 358 of the exhaust housing. The collar allows rotation of the fan housing, and provides an air-tight seal between the fan housing and exhaust housing.

The fan housing is shaped so that it may be rotated with respect to the exhaust port 358 of the exhaust housing 350 depending on the shape of the toilet's bowl and toilets water tank. Generally, the wide planar side 402 should be oriented upwardly, as seen in FIGS. 5–7 where the overhang of the toilet's water tank, past the edge of the toilet's bowl, will allow. Where there is insufficient space for the fan housing to be oriented in this manner without extending past the edge of the tank, the fan housing may be rotated, so that the narrow planar side 404 is oriented upwardly.

As seen in FIG. 10, a wide bi-planar side 406 is opposite the wide planar side 402, and a narrow bi-planar side 408 is opposite the narrow planar side 404. Two opposed thumb openings 410 are typically defined in the wide sides 402, 406, as seen in FIGS. 5 and 6. The thumb openings allow a user to easily grasp the filter 500 or damper assembly 550 carried inside the fan housing.

A wiring groove 418 provides a narrow recess through which a wire may pass. In a typical application, a wire will connect the switch 850 with the fan 450 and a battery or AC to DC adapter.

As seen in FIGS. 8 and 9, a fan 450 is carried inside the fan housing, and is typically slid rearwardly as far as possible.

A preferred version of the invention provides a charcoal or similar filter insert 500, which is carried in a rearward portion of the fan housing, as seen in FIG. 9. Air passes through the filter 500 where odors are removed before exiting from the fan housing 400 and moving into the room.

In an alternative embodiment of the invention, a damper assembly 550 may be used to replace the filter 500. The damper assembly is in communication with the air channel defined in the fan housing, and prevents air movement from the air channel in the fan housing into the air channel in the seat. Where a damper assembly is used, the exhaust air is vented to the outside or to the air ventilation pipes of the building's plumbing system. The damper assembly therefore prevents air from backing up within the system.

Referring to FIG. 8, an insert rim 552 of the damper assembly is sized to insert into a rearward portion of the fan housing 400, making a frictional fit. An end wall 554 prevents air from leaving the fan housing, except by travel through an exhaust port 556. The inner surface of the exhaust port 556 carries a damper seal 558, which allows the damper 560 to form a nearly air-tight seal.

In a preferred embodiment, a spring (not shown for reasons of clarity) biases the damper into the closed position. As a result, when the solenoid is deactivated or in the event of a power outage, the damper will close.

Damper opener means, mechanically attached to the damper, open the damper against the bias of the spring. In a preferred embodiment, the damper is opened by a solenoid 562, selected for its ability to overcome the bias of the spring.

Damper control means, executed in software by the microcontroller and in electrical communication with the fan and damper opener, coordinate the simultaneous operation of the fan and the opening of the damper. In operation, the microcontroller activate the fan and solenoid simultaneously, thereby opening the damper and moving air through it. The microcontroller then closes the damper and turns off the fan, preventing the passage of additional air.

Where a damper assembly 550 is utilized, a pipe adapter 600 is inserted into the end of the fan housing. The pipe adapter is held in place by an insert rim 606, which is sized to slide into the fan housing. A planar end wall 604 prevents air transfer, except through a circular exhaust port 602. A hose or a pipe may be installed on the exhaust port 602. The hose or pipe may be vented to the outside, or into an existing ventilation system. By rotation of the pipe adapter 600 and damper assembly 600, the exhaust port 602 may be aligned with a pipe extending from the wall.

In a modification of the invention having a fan, and a damper assembly carried by the fan housing, the fan may be installed at a remote location, typically at the end of the hose or pipe extending from the end of the pipe adapter 600. This allows the exhaust air to be pulled, rather than pushed. Also, any noise associated with the fan will be reduced.

Referring to FIG. 11, a version of a schematic representation of an electronic circuit card 900 usable with the invention is seen. A preferred version of the circuit is microcontroller-driven, and allows the software to configure the hardware to the application. The application may include a number of different variables, such as: a long or short exhaust pipe; damper or no damper; filter or no filter; large fan or small fan, and others.

The circuit provides a connector labeled J1 where a 12 volt direct current power supply may be attached. In a typical application, a 2-amp. fuse is provided. A voltage regulator provides 5 volt regulated direct current voltage to points on the circuit labeled Vcc.

A further connector labeled J2 allows attachment of the solenoid used by versions of the invention having the damper assembly attached.

A connector labeled J3 allows attachment of an anemometer to an input line of the microcontroller. The anemometer allows measurement of the air speed at key location(s) in the system in real time. The information from this sensor is received by the microcontroller periodically, allowing the microcontroller to increase or decrease the power sent to the fan.

A connector labeled J4 allows the attachment of a fan. An output line from the microcontroller controls the operation of the switching transistor Q5. Where a square wave is sent to transistor Q5, 12 Vdc is applied to the fan in a rapidly alternating manner at many cycles per second. The percentage of the time in which power is applied to the fan is therefore the percentage of the maximum possible power applied to the fan. Thus, the relative lengths of the on and off periods of the square wave are adjusted, as needed. This level is easily controlled by software executed by the microcontroller, and may be varied in real-time to compensate for changing air speed, changing voltage levels available for application to the fan and for other factors, as desired, such as the time elapsed since the switch at J5 was released.

A connector labeled J5 allows attachment of the switch which activates, and in some applications turns off, the fan. The preferred switch is closed when the system is in use, i.e. when someone is sitting on the seat. As seen in the schematic, when the switch is closed the input line to the microcontroller is pulled low. When the switch is released, the line is pulled back up to Vcc. A 47 K Ohm resister tied to Vcc prevents the line from floating.

In a preferred version of the invention, a PIC 12C508 microcontroller is programmed to control the operation of the circuit. Upon activation of the switch, power is latched to the microcontroller, allowing it to power up and control the circuit's operation.

Air speed control means, executed in software by the microcontroller determines the correlation between the air speed and the time during which the transistor Q5 should be turned on. Specifically, where the air speed is below the desired level, the transistor Q5 should be turned on for a greater percentage of the time, and where the air speed is greater than the desired level, the transistor Q5 is turned on for a smaller percentage of the time. Thus, where the toilet is vented to the outside, and wind or air pressure outside tends to draw air from the inside, or tends to reverse the air flow direction, then the air speed control means compensates by appropriately applying power to the fan.

In a preferred embodiment, delay circuit means cause the fan to continue to operate after the switch attached to J5 is released. In a preferred version of the electronic circuit, when the switch 850 is turned off, by the user getting off the seat 150, the microcontroller causes the fan to remain on for a delay of approximately 1 minute. The delay circuit means provides a timer executed in software which is initiated by release of the switch. If the switch closes prior to the end of the delay, the operation of the delay circuit means is canceled. The delay circuit means allows for further removal or filtration of the air, and also prevents the fan from turning on and off if the user shifts the amount of weight carried by the seat.

Delayed speed change means, executed in software, allows the fan to be operated at a different speed after a certain period of time has elapsed since the switch has been released. For example, it may be desirable to operate the fan at a high rate of speed while the switch senses a person is sitting on the seat and for a period of time thereafter. However, for an additional period of time, it may be advantageous to operate the fan at a slower, quieter, lower power-consuming speed. Alternatively, during the additional period of time, it may be advantageous to operate the fan at a higher rate of speed. Delayed speed change means in the software allows the power to the fan to be reduced (increased, or left the same) after a period of time has elapsed. For example, one minute after the switch is released, the fan may be operated for an additional minute, or indefinitely, at a power level which results in the air speed being higher or lower than the original level.

As seen in the schematic, manual adjustment means allows the user to adjust inputs to the microcontroller, and to thereby manually provide an air speed target level at which the microcontroller attempts to maintain the air speed. The variable resistor R11 may be adjusted, thereby applying an input level to the microcontroller representing a fan speed to which to target the fan's operation.

Manual control over the fan's speed allows battery power to be conserved, or air flow to be maximized, and also allows the selection from a wide variety of fans. The speed control means also allows the correct fan speed to ensure adequate air transfer no matter what length of tubing is required to vent to the outside. Where the system is not vented to the outside, control over the air speed allows the fan speed to increase if the filter becomes somewhat clogged. Additionally, some fans, due to their construction, use objectionable amounts of power or produce objectionable amounts of noise when operated at higher voltages, but are quieter and consume lower amounts of power when operated at lower voltage levels. Control over the fan's speed may therefore result in quieter system.

A battery low indicator light, seen in FIG. 11 as LED D3, is latched into the ON position if at any time the battery tests low. The portion of the circuit adjacent to LED D3 prevents the LED D3 from flickering on and off as the battery condition begins to fail and voltage levels drop. Also, the latching functionality prevents a low battery from rebounding slightly after use, resulting in a false failure for the battery low indicator to light.

In an alternate circuit embodiment, filter change notification means indicate to the user that the filter needs to be changed. A preferred filter change notification means includes an output line from the microcontroller used to activate a signal LED and functionality in the software of the microcontroller including a timer to measure the total time of the fan operation. When the elapsed time reached a predetermined value, a signal LED would indicate the need to replace or clean the filter.

As seen in FIG. 11, the LED D3 may be used for this purpose. Where the filter needs to be changed, D3 is blinked; where the power level is low, LED D3 is constantly on.

The 12 volt direct current required by the circuit and the fan for operation may be obtained from either a battery pack or an alternating current adapter which converts AC power to 12 volts DC.

To use the toilet ventilation system of the invention, the user must simply turn it on. In the preferred version of FIGS. 1–11, this is accomplished by turning the weight activated switch 850 on by sitting on the seat 150, thereby flexing the neck 704 of the hinges 700, putting pressure on the pressure sensitive switch 850.

To clean the toilet ventilation system, in the preferred version the user removes the air channel cover by reaching into the thumb hole 158 and pulling on the air channel cover 200. In the version of the invention of FIGS. 12–23, the user must unlock the pivoting support legs 27 by rotating them about the pivot posts 28. This allows easy removal of the air channel cover 40. Once removed, the air channel may be cleaned and the air channel cover reattached.

As a part of a regular maintenance program, the enclosure 300 may be snapped off, the base 250 cleaned, and the enclosure reattached.

The user may manually remove and replace the filter by using the thumb openings 410.

The previously described versions of the present invention have many advantages, including a primary advantage of providing a novel toilet ventilation system which is easily cleaned and maintained in an hygienic and odor free condition.

Another advantage of the present invention is to provide a toilet ventilation system having structures that are adaptable to installing a fan and odor absorbing filter within the bathroom, or to installing a fan in a remote location to exhaust the air through a duct to the building exterior.

Another advantage of the present invention is to provide a toilet ventilation system having electrical switching structures that may enable other functionality, such as automatic flushing of the toilet.

Another advantage of the present invention is to provide a toilet ventilation system having structures that are easily retrofitted to existing room and toilet.

Another advantage of the present invention is to provide a toilet ventilation system having structures that are concealable within an attractive enclosure conducive to commercial acceptance.

A still further advantage of the present invention is to provide a toilet ventilation system having a fan which is switched on and off in an automatic manner.

Although the present invention has been described in considerable detail and with reference to certain preferred versions, other versions are possible. For example, a number of variations in the design of the electronic circuit of FIG. 11 are possible, while still providing similar functionality. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A toilet ventilation system, for attachment to a toilet, comprising:

(A) a seat defining an air channel in a lower surface;

(B) an air channel cover, defining at least one slot, carried by the seat;

(C) a hinge, pivotably supporting the seat;

(D) a base having fastening means for attachment to a bowl of the toilet;

(E) an enclosure, carried by the base, defining an air channel in communication with the air channel defined by the lower surface of the seat;

(F) a fan housing, defining an air channel in communication with the air channel of the enclosure;

(G) fan means, carried by the fan housing, for moving air from the air channel in the seat, and then into the air channel in the enclosure, and then into the air channel in the fan housing, and then exhausting the air; and (H) circuit means, comprising a microcontroller-based circuit in electrical communication with the fan means, for controlling the operation of the fan, the circuit means comprising:

(a) switching means, in electrical communication with the fan means, for signaling the circuit means in response to weight carried by the seat;

(b) delay circuit means, executed by the microcontroller-based circuit and in electrical communication with the fan means, for turning the fan off after a delay period;

(c) manual air speed adjustment means, executed by the microcontroller-based circuit and in electrical communication with the fan means, for allowing adjustment of the speed of operation of the fan means, thereby manually providing an air speed target level for the fan means; and (d) air speed control means, executed by the microcontroller-based circuit and in electrical communication with the fan means, for automatically increasing or decreasing the speed of operation of the fan means substantially to maintain the manually selected air speed target level.

2. The toilet ventilation system of claim 1, the circuit means additionally comprising:

(a) delayed speed change means, executed by the microcontroller-based circuit and in electrical communication with the fan means, for operating the fan means at a speed other than that corresponding to the air speed target level after a period of time has elapsed.

3. A toilet ventilation system, for attachment to a toilet, comprising:

(A) a seat defining an air channel in a lower surface;

(B) an air channel cover, defining at least one slot, carried by the seat;

(C) a hinge, pivotably supporting the seat;

(D) a base having fastening means for attachment to a bowl of the toilet;

(E) an enclosure, carried by the base, defining an air channel in communication with the air channel defined by the lower surface of the seat;

(F) a fan housing, defining an air channel in communication with the air channel of the enclosure;

(G) fan means, carried by the fan housing, for moving air from the air channel in the seat, and then into the air channel in the enclosure, and then into the air channel in the fan housing, and then exhausting the air; and (H) circuit means, comprising a microcontroller-based circuit in electrical communication with the fan means, for controlling the operation of the fan, the circuit means comprising:

(a) switching means, in electrical communication with the fan means, for signaling the circuit means in response to weight carried by the seat;

(b) delay circuit means, executed by the microcontroller-based circuit and in electrical communication with the fan means, for turning the fan off after a delay period;

(c) manual air speed adjustment means, executed by the microcontroller-based circuit and in electrical communication with the fan means, for allowing adjustment of the speed of operation of the fan means, thereby manually providing an air speed target level for the fan means;

(d) air speed control means, executed by the microcontroller-based circuit and in electrical communication with the fan means, for automatically increasing or decreasing the speed of operation of the fan means substantially to maintain the manually selected air speed target level; and (I) damper assembly means, in communication with the air channel defined in the fan housing, for preventing air movement from the air channel in the fan housing into the air channel in the seat, the damper comprising:

(a) a damper, biased into a closed position, wherein air movement through the damper assembly is prevented;

(a) opener means, mechanically attached to the damper, for opening the damper against bias; and (a) damper control means, in electrical communication with the fan means and the opener means, for coordinating the simultaneous operation of the fan and the opening of the damper.

4. The toilet ventilation system of claim 3, the circuit means additionally comprising:

(a) delayed speed change means, executed by the microcontroller-based circuit and in electrical communication with the fan means, for operating the fan means at a speed other than that corresponding to the air speed target level after a period of time has elapsed.

* * * * *